US011203453B2

(12) United States Patent
Ichikawa

(10) Patent No.: US 11,203,453 B2
(45) Date of Patent: Dec. 21, 2021

(54) METHOD OF MANUFACTURING SPOUTED POUCH ASEPTICALLY FILLED WITH CONTENTS

(71) Applicant: HOSOKAWA YOKO CO., LTD., Tokyo (JP)

(72) Inventor: Toru Ichikawa, Misato (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 165 days.

(21) Appl. No.: 15/315,952

(22) PCT Filed: Jun. 19, 2015

(86) PCT No.: PCT/JP2015/068435
§ 371 (c)(1),
(2) Date: Dec. 2, 2016

(87) PCT Pub. No.: WO2016/189754
PCT Pub. Date: Dec. 1, 2016

(65) Prior Publication Data

US 2017/0107008 A1 Apr. 20, 2017

(30) Foreign Application Priority Data

Jun. 23, 2014 (JP) ..... JP2014-128254

(51) Int. Cl.
*B31F 1/28* (2006.01)
*B65B 55/02* (2006.01)
(Continued)

(52) U.S. Cl.
CPC ..... *B65B 55/027* (2013.01); *B65B 3/04* (2013.01); *B65B 7/02* (2013.01); *B65B 25/001* (2013.01);
(Continued)

(58) Field of Classification Search
CPC ..... B65B 55/027; B65B 55/10; B65B 55/04; B65B 55/02; B65B 55/022; B65B 55/001;
(Continued)

(56) References Cited

U.S. PATENT DOCUMENTS 3,050,914 A * 8/1962 Morgan, Jr. ..... B65B 55/10 53/426
4,366,125 A 12/1982 Kodera et al.
(Continued)

FOREIGN PATENT DOCUMENTS

CN 1042875 6/1990
CN 1164827 11/1997
(Continued)

OTHER PUBLICATIONS

International Search Report for International Application No. PCT/JP2015/068435, dated Oct. 6, 2015, 2 pages total.
(Continued)

*Primary Examiner* — Valentin Neacsu
*Assistant Examiner* — Jacob A Smith
(74) *Attorney, Agent, or Firm* — Nixon Peabody LLP; Jeffrey L. Costellia

(57) ABSTRACT

A method of manufacturing a spouted pouch aseptically filled with contents includes a supplying process, a sterilizing process, a stopper opening process, a filling process, a tightly re-stopping process, and a capping process. The sterilizing process, the stopper opening process, the filling process, and the tightly re-stopping process are performed in an aseptic chamber.

13 Claims, 6 Drawing Sheets

(51) Int. Cl.

| | |
|---|---|
| ***B65B 25/00*** | (2006.01) |
| ***B65B 7/02*** | (2006.01) |
| ***B65D 75/58*** | (2006.01) |
| ***B65B 55/10*** | (2006.01) |
| ***B65B 3/04*** | (2006.01) |
| ***B65B 43/42*** | (2006.01) |
| ***B65B 55/04*** | (2006.01) |
| ***B65B 61/20*** | (2006.01) |

(52) U.S. Cl.
CPC ..... *B65B 43/42* (2013.01); *B65B 55/04* (2013.01); *B65B 55/10* (2013.01); *B65B 61/20* (2013.01); *B65D 75/5883* (2013.01)

(58) Field of Classification Search
CPC ..... B65B 3/04; B65B 7/02; B65B 25/001; B65B 43/42; B65B 61/20; B65D 75/5883; B65D 51/18; B65D 41/34; B65D 41/3419
USPC ..... 53/426, 468, 471, 476, 281
See application file for complete search history.

(56) References Cited

U.S. PATENT DOCUMENTS 4,452,030 A * 6/1984 Inada ..... B65B 55/022 141/10
4,530,202 A 7/1985 Powell et al.
4,999,978 A * 3/1991 Kohlbach ..... B65B 55/022 141/114
5,129,212 A 7/1992 Duffey et al.
5,303,837 A * 4/1994 Adams ..... B65D 47/36 220/258.3
5,651,235 A * 7/1997 Ashley ..... B65B 7/01 53/458
5,788,940 A * 8/1998 Cicha ..... B65B 55/08 250/455.11
6,256,964 B1 * 7/2001 Drevfors ..... B65B 55/025 53/109
6,330,780 B1 * 12/2001 Shipway ..... B65B 55/022 53/268
6,925,780 B1 * 8/2005 Anderson ..... B65B 55/022 53/109
7,322,170 B2 * 1/2008 Tomalesky ..... B65B 7/2835 141/129
7,959,045 B2 * 6/2011 Kuge ..... B65D 47/123 222/495
8,413,409 B2 * 4/2013 Nighy ..... B65B 7/2835 53/281
8,646,243 B2 * 2/2014 Py ..... A23L 3/22 53/284
9,676,531 B2 * 6/2017 Johansson ..... B65D 41/205
2003/0159403 A1 * 8/2003 Verespej ..... B65D 75/5877 53/412
2005/0199313 A1 * 9/2005 Edwards ..... B65B 55/022 141/114
2006/0070997 A1 * 4/2006 Sjoholm ..... B65B 55/18 220/254.7
2006/0231519 A1 * 10/2006 Py ..... B65B 55/10 215/342
2008/0072542 A1 * 3/2008 Levati ..... B65B 31/024 53/426
2009/0056281 A1 * 3/2009 Murray ..... B65B 31/042 53/455
2010/0005760 A1 * 1/2010 Matheyka ..... B65B 55/08 53/426
2010/0170591 A1 * 7/2010 Murray ..... B65G 47/61 141/1
2010/0242414 A1 * 9/2010 Tauber ..... B65D 47/122 53/471
2011/0152051 A1 * 6/2011 Murray ..... B65B 61/186 493/213
2012/0085370 A1 * 4/2012 Auer ..... B65B 55/025 134/23
2012/0241456 A1 * 9/2012 Vovan ..... B65D 43/0254 220/270
2012/0279177 A1 * 11/2012 Macquet ..... B67C 7/0073 53/426
2012/0317936 A1 * 12/2012 Murray ..... B65B 3/045 53/545
2013/0126097 A1 * 5/2013 Murray ..... B29C 66/81431 156/516
2013/0160399 A1 * 6/2013 Rosselli ..... B65B 35/58 53/236
2013/0175273 A1 * 7/2013 Fox ..... B65D 51/00 220/259.3
2013/0199134 A1 * 8/2013 Huntington ..... B65D 47/08 53/471
2013/0213980 A1 * 8/2013 Pedmo ..... B65B 3/04 220/600
2013/0287905 A1 * 10/2013 Loisel ..... B65D 47/06 426/115
2017/0190456 A1 * 7/2017 Py ..... A61J 1/05

FOREIGN PATENT DOCUMENTS

CN 103429502 12/2013
CN 103587754 A 2/2014
EP 0694477 A1 1/1996
IT 0694477 A1 * 1/1996 ..... B65B 55/02
JP 58-149232 9/1983
JP 01182225 A * 7/1989
JP 11-180416 7/1999
JP 2001-514996 9/2001
JP 2002-321715 A 11/2002
JP 2003-72717 A 3/2003
JP 2003-237742 A 8/2003
JP 2006-206159 A 8/2006
JP 2011-098761 5/2011
JP 2011-140350 7/2011
JP 2013-018534 1/2013

OTHER PUBLICATIONS

European Search Report dated Dec. 14, 2017 issued in European Pat. Application No. 15892795.4 (based from PCT/JP2015/068435).
Chinese Office Action (Application No. 201580032732.1) dated Jun. 7, 2018.
Japanese Office Action (Application No. 2014-128254) dated May 29, 2018.
Japanese Office Action (Application No. 2018-170483) dated Aug. 20, 2019.
Chinese Office Action (Application No. 201910196603.6) dated Aug. 28, 2020.
European Search Report (EP Application No. 21167788.5) dated Jul. 7, 2021.

* cited by examiner

METHOD OF MANUFACTURING SPOUTED POUCH ASEPTICALLY FILLED WITH CONTENTS

TECHNICAL FIELD

The present invention relates to a method of manufacturing a spouted pouch aseptically filled with contents and a pack.

Priority is claimed on Japanese Patent Application No. 2014-128254, filed on Jun. 23, 2014, the content of which is incorporated herein by reference.

BACKGROUND ART

Retort pouches are generally used as packaging containers that preserve food and the like for a long period.

Typically, in the retort pouches, the foods can be preserved for a long period by "retort sterilization treatment" of sterilizing the food in the packaging container by sealing the packaging container filled with contents and then heating and sterilizing the packaging container at a high temperature.

However, in the retort sterilization treatment, the food is usually exposed at a higher temperature for a longer time in order to carry out sufficient sterilization, and thus a texture and flavor of the food are undeniably reduced according to thermal history.

On the other hand, for the sake of ease of drinking, ease of pouring, convenience, and so on, pouches to which spouts are attached (hereinafter referred to as "spouted pouches") have recently been used as food packaging containers (e.g., Patent Literature 1). Even in the spouted pouches, to preserve food and the like for a long period, the food and the like need to be kept sterile.

For the spouted pouches, methods of aseptically filling them with food and the like which do not necessarily require retort sterilization treatment are developed. For example, a method of aseptically filling a spouted pouch is disclosed in Patent Literature 2, and requires no retort sterilization treatment because outer surface sterilization treatment is performed on the spouted pouch, a pouch container of which is previously subjected to radiation sterilization treatment, in a filling machine in a sealed state, the sealed state is released to fill the spouted pouch with contents that are previously subjected to sterilization treatment, and the pouch container is sealed using a cap subjected to sterilization treatment in a separate process.

CITATION LIST

Patent Literature

[Patent Literature 1]
Japanese Unexamined Patent Application, First Publication No. 2006-206159
[Patent Literature 2]
Japanese Unexamined Patent Application, First Publication No. 2003-237742

SUMMARY OF INVENTION

Technical Problem

However, the aseptically filling method described in Patent Literature 2 is complicated because it has the separate process of performing the sterilization treatment on the cap.

Also, an aseptically filling system used in the aseptically filling method has a machine for the separate process, and thus the structure is complicated and miniaturization is difficult. Further, since an interior of the machine for the separate process should be kept sterile, maintenance of the system becomes cumbersome.

Furthermore, since a tamperproof function by which discrimination between an opened state and an unopened state is possible has recently been applied to caps, a structure thereof has become complicated. When a cap having such a complicated structure is sterilized, there are portions to which hydrogen peroxide is not sprayed, and thus the sterilization is like to be insufficient. For this reason, the sterilization of the cap having the complicated structure should be thoroughly performed, for instance, the hydrogen peroxide should be sprayed from all directions. Accordingly, when the cap having the complicated structure is used, the previous methods of aseptically filling the spouted pouch become further complicated in the process and the system also becomes more complicated and larger.

The present invention provides a method of manufacturing a spouted pouch filled aseptically with contents, in which, even if a cap having a tamperproof function and a complicated structure is used when the spouted pouch is easily aseptically filled with the contents such as foods, a system is made small and provides easy maintenance.

Solution to Problem (1) A method of manufacturing a spouted pouch aseptically filled with contents includes: a supplying process of at least supplying part of a spout and a stopper of the spouted pouch, to which the spout tightly stopped by the stopper is attached and an interior of which is sterilized in a sealed state, into an aseptic chamber; a sterilizing process of at least sterilizing a part of a surface of the spout and a surface of the stopper after the supplying process; a stopper opening process of removing the stopper from the spout after the sterilizing process; a filling process of filling the spouted pouch with the contents from the spout after the stopper opening process; a tightly re-stopping process of attaching any stopper removed in the stopper opening process to the spout after the filling process; and a capping process of mounting a cap on the spout to cover the stopper after the tightly re-stopping process. The sterilizing process, the stopper opening process, the filling process, and the tightly re-stopping process are performed in the aseptic chamber.

(2) In the method described in (1) , a central portion of the stopper includes a protrusion formed in an outward direction in a state in which the spout is tightly stopped by the stopper.

(3) In the method described in (1) or (2) , the stopper is integrated with the cap in the capping process.

(4) A pack used in the method described in any one of (1) to (3) includes: a plurality of spouted pouches, to which the spouts tightly stopped by the stoppers are attached and the interiors of which are sterilized in the sealed state; and a holder configured to hold the plurality of spouted pouches together. The plurality of spouted pouches are held together by the holder, and the plurality of spouted pouches are continuously supplied into the aseptic chamber from the holder in the supply process.

Advantageous Effects of Invention

According to the present invention, the method of manufacturing the spouted pouch aseptically filled with the contents, in which the spouted pouch can be easily filled with the contents such as foods, a system can be small even if a cap having a tamperproof function and a complicated structure is used, and maintenance of the system is easy, can be provided.

DESCRIPTION OF EMBODIMENTS

<Method of Manufacturing Spouted Pouch Filled Aseptically with Contents>

An embodiment of a method of manufacturing a spouted pouch filled aseptically with contents (hereinafter referred to simply as "present method") of the present invention will be described using FIGS. 1 to 3.

Figure 1:
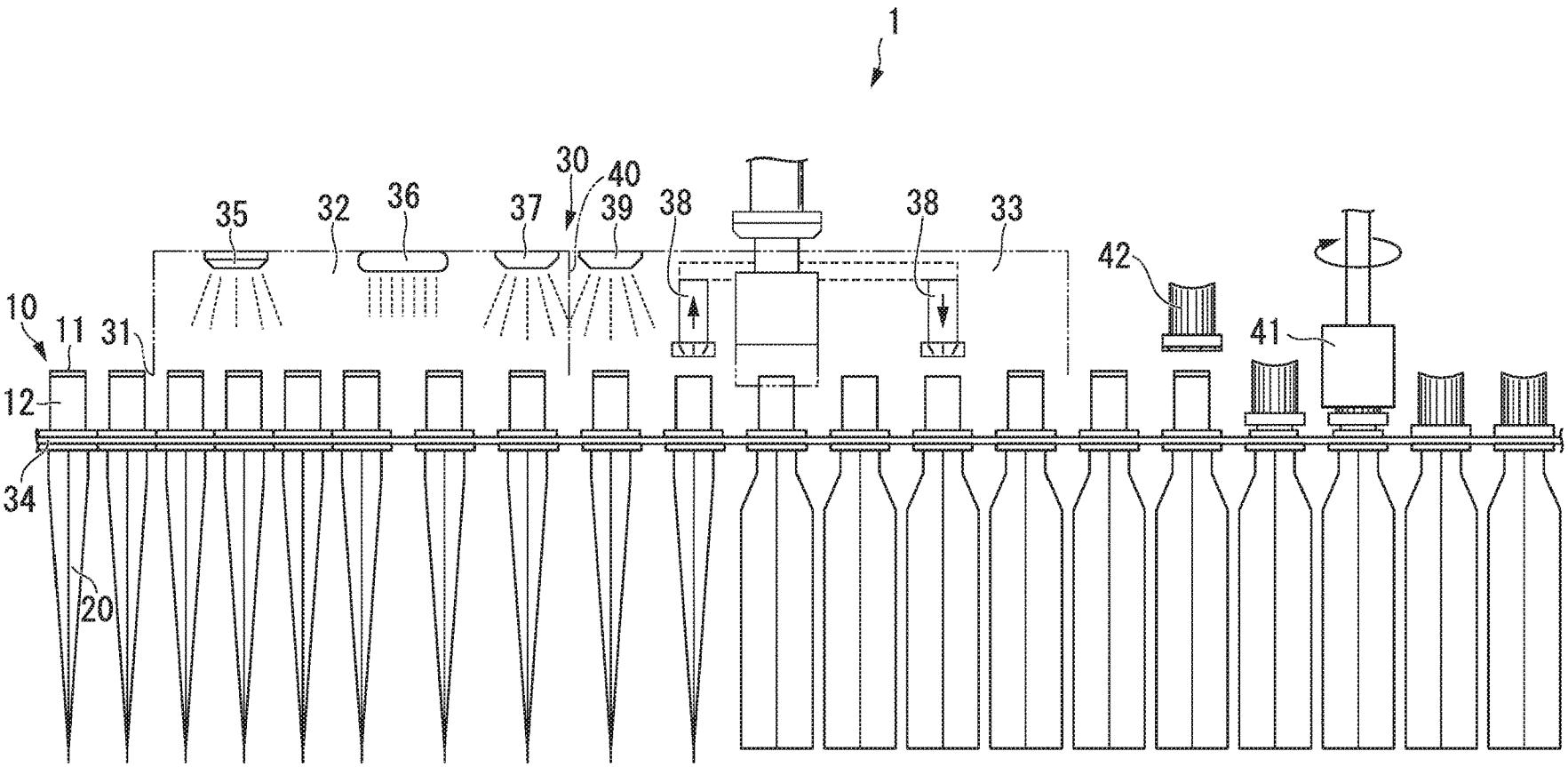
FIG. 1 is a schematic view illustrating each process of an embodiment of a method of manufacturing a spouted pouch aseptically filled with contents in the present invention.

FIG. 1 is a schematic view illustrating each process of an embodiment of the present method.

The present embodiment has a supplying process, a sterilizing process, a stopper opening process, a filling process, a tightly re-stopping process, and a capping process. In the present embodiment, spouted pouches 10 are continuously processed by a system 1 while moving in a rightward direction of FIG. 1. In the present embodiment, the sterilizing process, the stopper opening process, the filling process, and the tightly re-stopping process are performed inside an aseptic chamber 30 of the system 1, and the capping process is performed outside the aseptic chamber 30 of the system 1.

Hereinafter, each component of the present embodiment will be described.

(Spouted Pouch)

The spouted pouch 10 illustrated in FIG. 1 is configured with a spout 12, which is tightly stopped by a stopper 11, attached thereto, and an interior thereof is sterilized in a sealed state.

Figure 2:
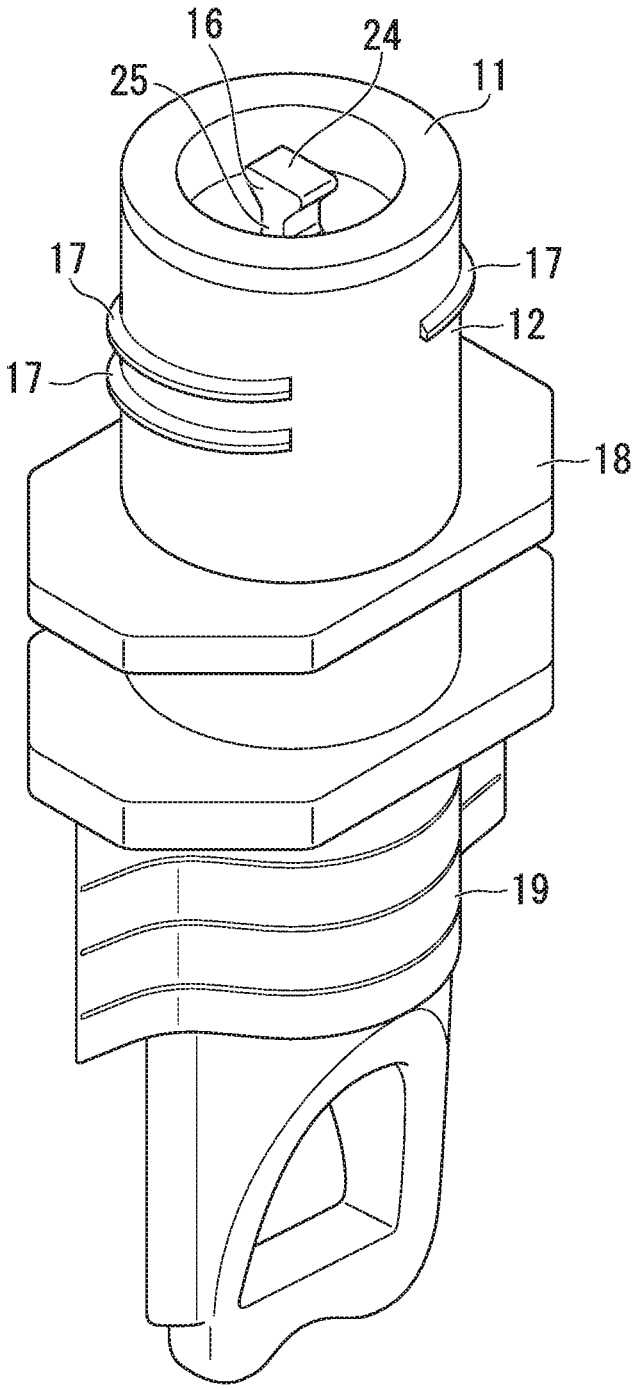
FIG. 2 is a perspective view illustrating a state in which a spout is tightly stopped by a stopper in the embodiment.

FIG. 2 is a perspective view illustrating a state in which the spout 12 is stopped tightly by the stopper 11 in the present embodiment. FIG. 3 is a front sectional view illustrating the state in which the spout 12 is stopped tightly by the stopper 11 in the present embodiment.

A pouch 20 of the present embodiment has a saclike shape and is not particularly limited but may be any known structure that can be used as a pouch. A handle may be attached to the pouch 20 for easy portability of the pouch, for instance, when the pouch is filled with a large amount of water.

A material of the pouch 20 is not particularly limited as long as it is a resin that can be filled with contents such as foods, and may include, for example, a polyethylene resin film or a polypropylene resin film. Also, if an olefin resin film such as a polyethylene resin film or a polypropylene resin film is used as the material of the pouch 20, adhesiveness of the pouch 20 and the spout 12 can be further increased.

In addition, the material of the pouch 20 preferably includes a resin film whose gas permeability is suppressed to prevent contents from being oxidized by oxygen permeating from the outside, and more preferably a laminated film.

A type of the laminated film may include, for instance, a laminated film made up of a base layer and a thermal fusion layer, a laminated film made up of a barrier layer and a thermal fusion layer, a laminated film made up of a base layer, a barrier layer, and a thermal fusion layer, or a laminated film made up of a base layer, a barrier layer, a functional layer, and a thermal fusion layer.

The base layer is designed to be located at a surface side of the pouch 20, and has excellent printability and preferably resistance to piercing, rigidity, and resistance to impact. A material of the base layer may include a stretched film of, for instance, polyester, polyamide, or polypropylene. The base layer preferably has a thickness of 5 to 50 μm.

The thermal fusion layer is designed to be located at an innermost layer of the pouch 20, and further facilitates adhesion between peripheries of the pouch 20 and between the pouch 20 and the spout 12. A material of the thermal fusion layer is not particularly limited but may be any that is typically used for a pouch and is preferably a polyolefin such as low-density polyethylene, medium-density polyethylene, high-density polyethylene, linear low-density polyethylene, or polypropylene for the purpose of increasing adhesiveness between the pouch 20 and the spout 12. To further increase the adhesiveness between the pouch 20 and the spout 12, the same material as the spout 12 (e.g., polyethylene in the case of polyethylene, polypropylene in the case of polypropylene, etc.) is preferably used as the material of the pouch 20. The thermal fusion layer preferably has a thickness of 20 to 150 μm.

The barrier layer is provided to further suppress gas permeability. A material of the barrier layer may include an inorganic vapor-deposited film formed by vapor-depositing a metal such as aluminum or a metal oxide such as alumina or silica on the aforementioned base layer, in addition to a metal foil of, for instance, aluminum, copper, or magnesium. When the barrier layer is located outside the pouch 20, for instance, in the laminated film made up of the barrier layer and the thermal fusion layer, the barrier layer is preferably used as the inorganic vapor-deposited film for an anti-stripping effect. The barrier layer preferably has a thickness of 5 to 30 μm.

The functional layer is provided so that the pouch 20 is durable in terms of piercing strength, falling strength, etc. A material of the functional layer may include a stretched film of, for instance, polyester, polyamide, or polypropylene. The functional layer preferably has a thickness of 5 to 50 μm.

A capacity of the pouch 20 is not particularly limited and is set according to use. For example, when filled with food contents, the capacity of the pouch 20 may be adequately set within a range of 30 to 2000 mL.

The pouch 20 may be manufactured by a known method of manufacturing a packing material.

As illustrated in FIG. 2, the spout 12 of the present embodiment is a molding that is attached to the pouch 20 and is formed of a plastic resin and is a tubular body that spatially connects the interior and exterior of the pouch 20.

An attachment area of the spout 12 to the pouch 20 is not particularly limited, but is typically an upper portion of the pouch 20 such that the contents are not ejected when the spout 12 is opened.

Since a cap 42 to be described below is fastened in a screw type, the spout 12 of the present embodiment is formed with threads 17 on an outer surface thereof.

Also, the spout 12 of the present embodiment is formed with a flange 18 that protrudes outward from the outer surface thereof. The spouted pouch 10 is suspended on a conveyance plate 34 by the flange 18 and is conveyed in the system 1. Also, in the system 1, a conveyance interval of the spouted pouch 10 is maintained using the flange 18. Further, a position of the spouted pouch 10 is controlled using the flange 18 such that a treatment is accurately performed in each process. In addition, the flange 18 is also used during suspension on a suspension part 51 of a holder 50 to be described below.

Also, the spout 12 of the present embodiment is formed with a pouch attachment part 19 below the flange 18. The pouch 20 is fixed to the pouch attachment part 19 without a gap by thermal fusion.

An inner diameter of the spout 12 is not particularly limited, and preferably ranges from 5 mm to 30 mm. If the inner diameter of the spout 12 is equal to or greater than 5 mm, it is easy to take out the contents. On the other hand, if the inner diameter of the spout 12 is equal to or smaller than 30 mm, the stopper 11 (to be described below) does not easily fall out when the spouted pouch 10 is stored or conveyed.

A thickness of a wall of the spout 12 is not particularly limited, and preferably ranges from 0.5 mm to 5 mm. If the thickness of the wall of the spout 12 is equal to or greater than 0.5 mm, it is easy for a shape of the spout 12 to be maintained in a cylindrical shape because it is possible to obtain sufficient hardness. On the other hand, if the thickness of the wall of the spout 12 is equal to or smaller than 5 mm, a material cost is reduced, and the spout 12 is light.

A material of the spout 12 is not particularly limited, and may include, for instance, a polyolefin such as low-density polyethylene, medium-density polyethylene, high-density polyethylene, linear low-density polyethylene, or polypropylene. With contents such as food products, in consideration of the fact that the spout is rarely damaged during eating and drinking and would have little influence on a living body even if it were ingested, the material of the spout 12 is preferably the medium-density polyethylene, the high-density polyethylene, the linear low-density polyethylene, or the polypropylene, and more preferably the high-density polyethylene or the polypropylene because of their low gas permeability.

The spout 12 may be manufactured by a known molding method. The molding method may include, for instance, injection molding or compression molding.

The stopper 11 of the present embodiment is a basin type, and has a circular shape when viewed from above. As illustrated in FIG. 3, a bottom 21 of the stopper 11 is inserted into an opening 13 of the spout 12. An edge 14 of the stopper 11 extends outward, and a lower surface 22 of the stretched portion thereof is in close contact with a mouth 15 of the spout 12. Also, an outer surface 23 of the stopper 11 is also in close contact with an upper portion of an inner wall of the spout 12. The stopper 11 is in close contact with the spout 12 in this way, thereby tightly stopping the spout 12.

An outer diameter of the outer surface 23 of the stopper 11 is preferably greater than an inner diameter of the spout 12 by 0.05 to 0.5 mm, and more preferably by 0.1 to 0.3 mm. As the outer diameter of the outer surface 23 of the stopper 11 is preferably greater than the inner diameter of the spout 12 by such a range, tightly stopping is more reliable, and further the stopper 11 does not easily fall out of the spout 12. In addition, in the higher part of this range, the stopper 11 can be compressed and fitted into the spout 12.

A height h (see FIG. 3) of the stopper 11 may be adequately set to a range within which it is easy to remove the stopper 11 in the stopper opening process to be described below, but is preferably within a range in which the spout 12 can be stopped sufficiently tightly and removal or tightly re-stopping can be performed from the spout 12 by means of a stopper attaching/detaching machine 38 to be described below. As a specific application example, the height h of the stopper 11 is preferably 1.5 to 10 mm, and more preferably 2.5 to 5.5 mm.

As the stopper 11 has the structure described above, it is not easily removed from the spout 12 even if an internal pressure of the spouted pouch 10 is raised, and it is possible to keep the interior of the spouted pouch 10 sterile.

Figure 3:
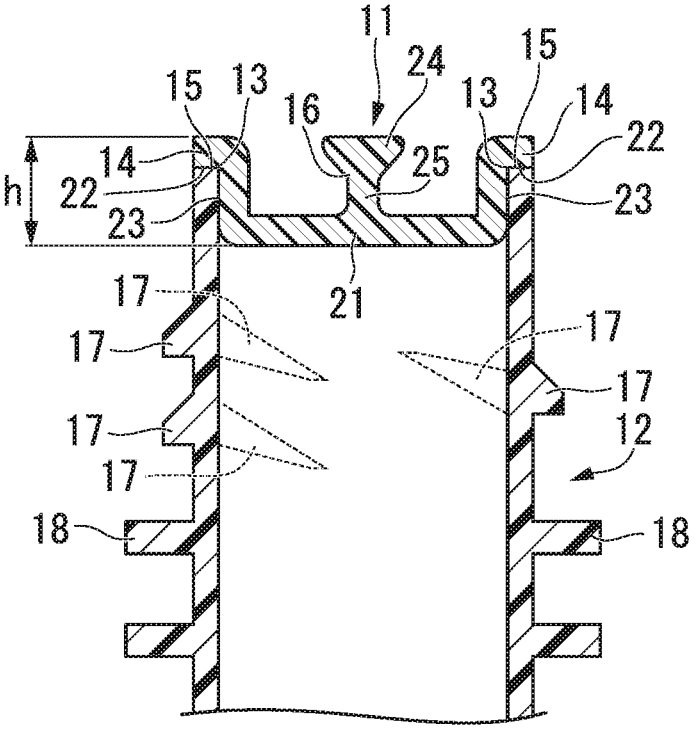
FIG. 3 is a front sectional view illustrating the state in which the spout is tightly stopped by the stopper in the embodiment.

As illustrated in FIGS. 2 and 3, a central portion of the stopper 11 has a protrusion 16 formed in an outward direction in a state in which the spout 12 is tightly stopped by the stopper 11. Note that an inward direction of the stopper 11 is a direction of the stopper 11 which faces the contents in the spouted pouch 10 filled with the contents and that an outward direction of the stopper 11 is a direction opposite to the inward direction of the stopper 11 and an upward direction in the present embodiment. The protrusion 16 has a structure in which a tip 24 thereof is larger than a base 25 thereof. As the protrusion 16 has such a structure, the stopper 11 is easily removed from the spout 12 in the stopper opening process to be described below, and does not easily fall from the stopper attaching/detaching machine 38 (to be described below) until it reaches the tightly re-stopping process to be described below.

A material of the stopper 11 is not particularly limited as long as it is a material having high adhesion to the spout 12, and may include, for instance, a resin including a polyolefin such as low density polyethylene, medium density polyethylene, high density polyethylene, linear low density polyethylene, polypropylene. Among these, low density polyethylene or linear low density polyethylene is preferable in terms of further increasing adhesion to the spout 12 and making a tightly stopping state more reliable.

The stopper 11 formed of the resin may be manufactured by a known molding method. The molding method may include, for instance, injection molding or compression molding.

The spouted pouch 10 is provided to the supplying process (to be described below) in a state in which an interior thereof is previously sterilized.

A method of previously sterilizing the interior of the spouted pouch 10 is not particularly limited, but may include, for instance, radiation exposure. The radiation may include, for instance, y rays, electron rays, or X-rays. A dose of the radiation to be applied is sufficient if it is to an extent that it is typically performed in a sterilization operation and is preferably to an extent, for instance, at which the interior of the spouted pouch 10 can be sufficiently sterilized and qualities of the stopper 11, the spout 12, and the pouch 20 are not degraded.

(Supplying Process)

As illustrated in FIG. 1, in the supplying process of the present embodiment, part of the spout 12 and the stopper 11 (hereinafter also referred to as "aseptic chamber supply regions") in the spouted pouch 10 are supplied into an aseptic chamber 30 through a supply section 31. The supply of the aseptic chamber supply regions into the aseptic chamber 30 is performed by putting the flange 18 (see FIGS. 2 and 3) on the conveyance plate 34 and suspending the spouted pouch 10. Accordingly, in the present embodiment, an upper portion of the spout 12 which is located over the flange 18 corresponds to the "part of the spout 12."

As the spouted pouch 10 suspended on the conveyance plate 34 is conveyed in a rightward direction of FIG. 1 by a conveyance jig, the aseptic chamber supply regions are supplied into the aseptic chamber 30 through the supply section 31 and are treated in the subsequent process. An interior of the aseptic chamber 30 is constituted of two chambers, i.e., a sterilizing chamber 32 and a filling chamber 33. To keep the interior of the aseptic chamber 30 sterile, either of the chambers is maintained at a positive pressure such that external air does not enter the interior of the aseptic chamber 30.

(Sterilizing Process)

In the sterilizing process of the present embodiment, surfaces of the aseptic chamber supply regions supplied into the aseptic chamber 30 are sterilized by the sterilizing chamber 32 inside the aseptic chamber 30.

As a procedure of the sterilizing method of the present embodiment, first, hydrogen peroxide is sprayed onto the surfaces of the aseptic chamber supply regions by a sprayer 35. The sprayed hydrogen peroxide is liquefied on and attached to the surfaces of the aseptic chamber supply regions, or becomes vaporized hydrogen peroxide in the sterilizing chamber 32, thereby exerting a sterilizing effect.

Next, ultraviolet (UV) light is applied to the surfaces of the aseptic chamber supply regions by a UV irradiator 36.

In the present embodiment, a shutter 40 is installed between the sterilizing chamber 32 and the filling chamber 33. The shutter 40 is opened and closed in the event of passage of the aseptic chamber supply regions. A direction in which the shutter 40 is opened and closed may be an upward/downward direction or a transverse direction. While the shutter 40 is being closed, the interior of the sterilizing chamber 32 may be filled or saturated with the vaporized hydrogen peroxide, and thereby the sterilizing effect is further increased. While the interior of the sterilizing chamber 32 is being filled or saturated with the vaporized hydrogen peroxide, the application of the UV light caused by the UV irradiator 36 is also performed. Thereby, the sterilizing effect is synergistically improved, compared to when the vaporized hydrogen peroxide treatment and the UV application are performed independently or consecutively.

Next, hot air is caused to blow to the surfaces of the aseptic chamber supply regions by a dryer 37, and the surface of the stopper 11 and the surface of the spout 12 are sufficiently dried. Air taken from an exterior of the aseptic chamber 30 or circulated in the aseptic chamber 30 may be used as the hot air. However, in any case, the hot air is sterilized by a sterilizing filter such as a high efficiency particulate air (HEPA) filter.

After the sterilizing process, the spouted pouch 10 is transferred to the filling chamber 33.

In the present embodiment, the hot air is caused to further blow to the surfaces of the aseptic chamber supply regions transferred to the filling chamber 33 by the dryer 39, and the surfaces of the aseptic chamber supply regions are completely dried.

(Stopper Opening Process)

In the stopper opening process of the present embodiment, after the surfaces of the aseptic chamber supply regions are completely dried, the stopper 11 is removed from the spout 12 by a stopper attaching/detaching machine 38 at the filling chamber 33 in the aseptic chamber 30.

In the removal operation, the stopper 11 is picked up using the aforementioned protrusion 16. As described above, since the protrusion 16 has the structure in which the tip 24 thereof is larger than the base 25 thereof, the stopper 11 is easily picked up and removed from the spout 12 in this stopper opening process, and does not easily fall from the stopper attaching/detaching machine 38 until it reaches the tightly re-stopping process to be described below.

(Filling Process)

In the filling process of the present embodiment, the interior of the spouted pouch 10 is filled with the contents from the spout 12 at the filling chamber 33 in the aseptic chamber 30. The contents are subjected to sterilization treatment prior to filling, and are filled in a sterilized condition.

The contents do not spoil due to multiplication of bacteria, and may include, for instance, food products, drinks, oral medicines, or quasi-drugs. Characteristics of the contents preferably include that they are a liquid material or a jelly-like material.

A method of sterilizing the contents is not particularly limited as long as it is a known method used for sterilizing contents, and may include, for instance, ultra-high temperature treatment (UHT) plate sterilization, tubular sterilization, spinjection sterilization, joule sterilization, or filter sterilization. When a liquid such as milk is used as the contents, the UHT plate sterilization is preferred. When the contents are mixed with solids such as pulp-containing juice, the tubular sterilization is preferred.

(Tightly Re-Stopping Process)

In the tightly re-stopping process of the present embodiment, any stopper 11 removed in the aforementioned stopper opening process is attached to the spout and is tightly stopped at the filling chamber 33 in the aseptic chamber 30. The stopper 11 is carried by the aforementioned stopper attaching/detaching machine 38 and is attached to the spout 12.

Therefore, the interior of the spouted pouch 10 and the surfaces of the aseptic chamber supply regions are maintained in the sterilized condition from the stopper opening process to the tightly re-stopping process.

The stopper 11 may be attached to the original spout 12 from which the same stopper 11 is removed in the stopper opening process, or may be attached to another spout 12 from which another stopper 11 is removed in the stopper opening process separately from the stopper 11. That is, any stopper 11 removed in the stopper opening process may be attached to any spout 12.

In the present embodiment, after the tightly re-stopping process, the spouted pouch 10 is further conveyed in the rightward direction of FIG. 1, and thereby the aseptic chamber supply regions are transferred outside the aseptic chamber 30.

(Capping Process)

In the capping process of the present embodiment, first, a cap 42 is mounted to cover the stopper 11 outside the aseptic chamber 30, and then is seamed to the spout 12 by a cap seamer 41.

In view of quality, it is sufficient if the cap 42 is clean, and it need not necessarily be completely sterilized in order to prevent the contents from spoiling. The cap 42 may be a known structure that is combined with and attached to the spout 12, but typically has a cylindrical shape in which one end thereof is open. In the present embodiment, since the cap 42 is fitted around the spout 12 in a screw type, an inner surface of the cap 42 is provided with threads corresponding to the threads 17 of the spout 12.

An inner diameter and length of the cap 42 may be set such that the spout 12 is fitted into the cap 42.

A thickness of a wall of the cap 42 is not particularly limited, and preferably ranges from 0.5 to 5 mm. If the thickness of the wall of the cap 42 is equal to or greater than 0.5 mm, it is easy for a shape of the cap 42 to be maintained in a cylindrical shape because it is possible to obtain sufficient hardness. On the other hand, if the thickness of the wall of the cap 42 is equal to or smaller than 5 mm, a material cost is reduced, and the cap 42 is light.

A material of the cap 42 is not particularly limited, but may include, for instance, a polyolefin such as low density polyethylene, medium density polyethylene, high density polyethylene, linear low density polyethylene, or polypropylene. Among these, high density polyethylene and polypropylene are preferred because they provide high adhesion to the spout 12 and have low gas permeability.

(Other Aspects)

A shape of the protrusion 16 of the stopper 11 can be freely designed as long as the stopper 11 can be attached to and detached from the spout 12 in the stopper opening process by the stopper attaching/detaching machine 38.

In the supplying process, the supply into the aseptic chamber 30 is not limited to only the aforementioned aseptic chamber supply regions. For example, the entire spouted pouch 10 may be supplied into the aseptic chamber 30. However, in order to further suppress labor and cost for the sterilization treatment, only the aseptic chamber supply regions are preferred, and it is more preferable that the aseptic chamber supply regions be within a narrower range.

In the sterilizing process, the shutter 40 does not have to be installed between the sterilizing chamber 32 and the filling chamber 33. In place of the shutter 40, a fixed partition may be installed. When the fixed partition is installed, the partition is formed with a minimum passage hole through which the stopper 11 and the spout 12 can pass. Due to the minimum passage hole, the interior of the sterilizing chamber 32 is easily filled or saturated with the vaporized hydrogen peroxide, and thus the sterilization is made more reliable.

In addition, instead of filling or saturating the interior of the sterilizing chamber 32 with the vaporized hydrogen peroxide to perform the sterilization, the sterilization may be performed by filling or saturating the interior of the sterilizing chamber 32 with steam (high-temperature water vapor). When the steam is used, it is preferable that the shutter 40 be installed to perform high-pressure vapor sterilization, and the sterilizing chamber 32 be maintained in a tightly closed state by the shutter 40 during the sterilization.

A design for the sterilizing chamber 32 and the filling chamber 33 can be modified by modifying an attachment location of the shutter 40. For example, the shutter 40 may be attached between the sprayer 35 and the UV irradiator 36, between the UV irradiator 36 and the dryer 37, or between the dryer 37 and the dryer 39. In order to further reduce an amount of the hydrogen peroxide used and further lower manufacturing costs by further reducing an internal volume of the sterilizing chamber 32, the attachment location of the shutter 40 is preferably between the sprayer 35 and the UV irradiator 36 or between the UV irradiator 36 and the dryer 37. Further, in order to obtain a higher sterilizing effect, the attachment location of the shutter 40 is more preferably between the UV irradiator 36 and the dryer 37.

Also, in the stopper opening process, even if the stopper 11 is not formed with the protrusion 16, the stopper 11 may be attached to and detached from the spout 12 by the stopper attaching/detaching machine 38. In this case, the stopper 11 does not have to be formed with the protrusion 16. A method of removing the stopper 11 from the spout 12 using the stopper attaching/detaching machine 38 when the stopper 11 is not formed with the protrusion 16 may include a method of raising the central portion of the stopper 11 by vacuum suction or a method of raising an end of the edge 14 of the stopper 11 using three or more claws.

The capping process may be performed in the filling chamber 33 after the tightly re-stopping process, or in a space that is provided separately from the filling chamber 33 in order to attach the cap.

The cap 42 preferably has a tamperproof function by which discrimination between an opened state and an unopened state is possible.

Figure 4:
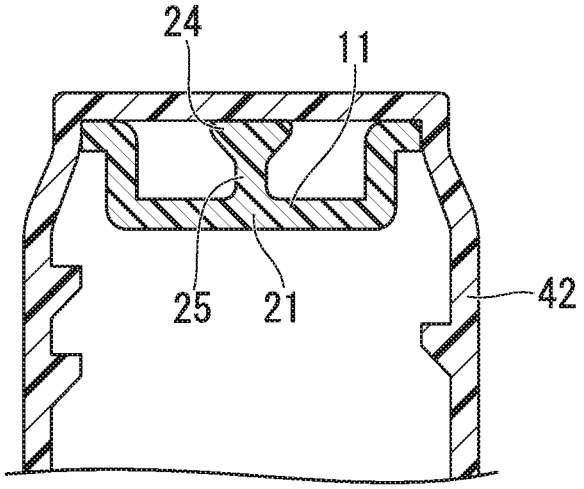
FIG. 4 is a front sectional view illustrating an example of a state in which the stopper is integrated with a cap.
Figure 5:
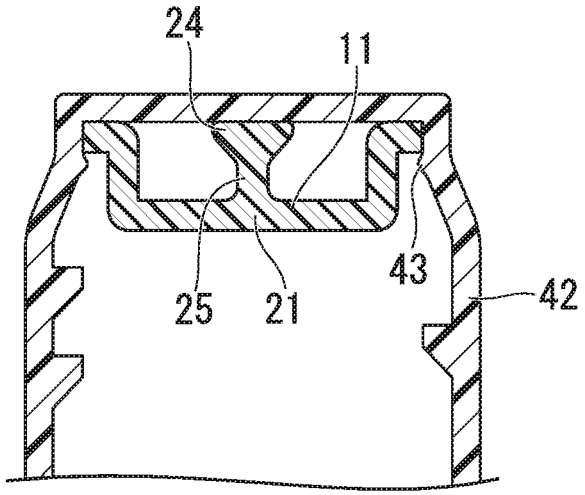
FIG. 5 is a front sectional view illustrating another example of the state in which the stopper is integrated with the cap.
Figure 6:
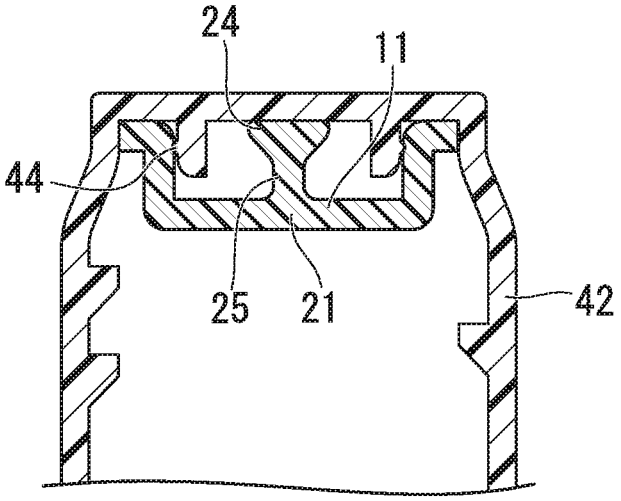
FIG. 6 is a front sectional view illustrating another example of the state in which the stopper is integrated with the cap.

The stopper 11 may or may not be integrated with the cap 42 in the capping process. The term "integrated" used herein means that the stopper 11 is fitted into an interior of the cap 42, and thereby when the cap 42 is removed from the spout 12, the stopper 11 is removed in a state in which it is fitted into the interior of the cap 42 without remaining in the spout 12. In FIGS. 4 to 6, an example of the state in which the stopper 11 is integrated with the cap 42 is illustrated in a front sectional view.

In FIG. 4, the end of the edge 14 of the stopper 11 is in close contact with an inner wall of the cap 42, and the stopper 11 is not easily removed from the cap 42. The material of the stopper 11 and the material of the cap 42 are combined such that a coefficient of friction is high, and thereby the stopper 11 is not easily removed from the cap 42.

Also, if an undercut 43 illustrated in FIG. 5 or an undercut 44 illustrated in FIG. 6 is provided, the stopper 11 is more easily integrated with the cap 42.

In order for the stopper 11 to be easier to open when the cap 42 is opened to use the contents aseptically filled according to the present invention, the stopper 11 is preferably integrated with the cap 42 in the capping process.

(Operation and Effects)

According to the present embodiment, in the method of manufacturing the spouted pouch aseptically filled with the contents, since it is unnecessary to sterilize the cap, even if the cap having the tamperproof function and the complicated structure is used, the processes are simpler, and the system becomes simpler and smaller. Also, since the system becomes simpler and smaller, maintenance of the system such as disassembly and cleaning is facilitated.

Also, in the present embodiment, since the stopper is previously attached to the spouted pouch, the surfaces of the stopper and the spout only need to be sterilized in the space inside the aseptic chamber, and a separate machine need not be provided outside the aseptic chamber. Accordingly, the system is small.

Further, even when the surfaces of the stopper and the spout are sterilized in the aseptic chamber, sufficient sterilization is easy because the structure of the stopper is not complicated. Furthermore, the surfaces of the stopper and the spout can be sterilized in the small space in the system, the system is small.

<Pack>

An embodiment of a pack of the present invention will be described using FIG. 7.

Figure 7:
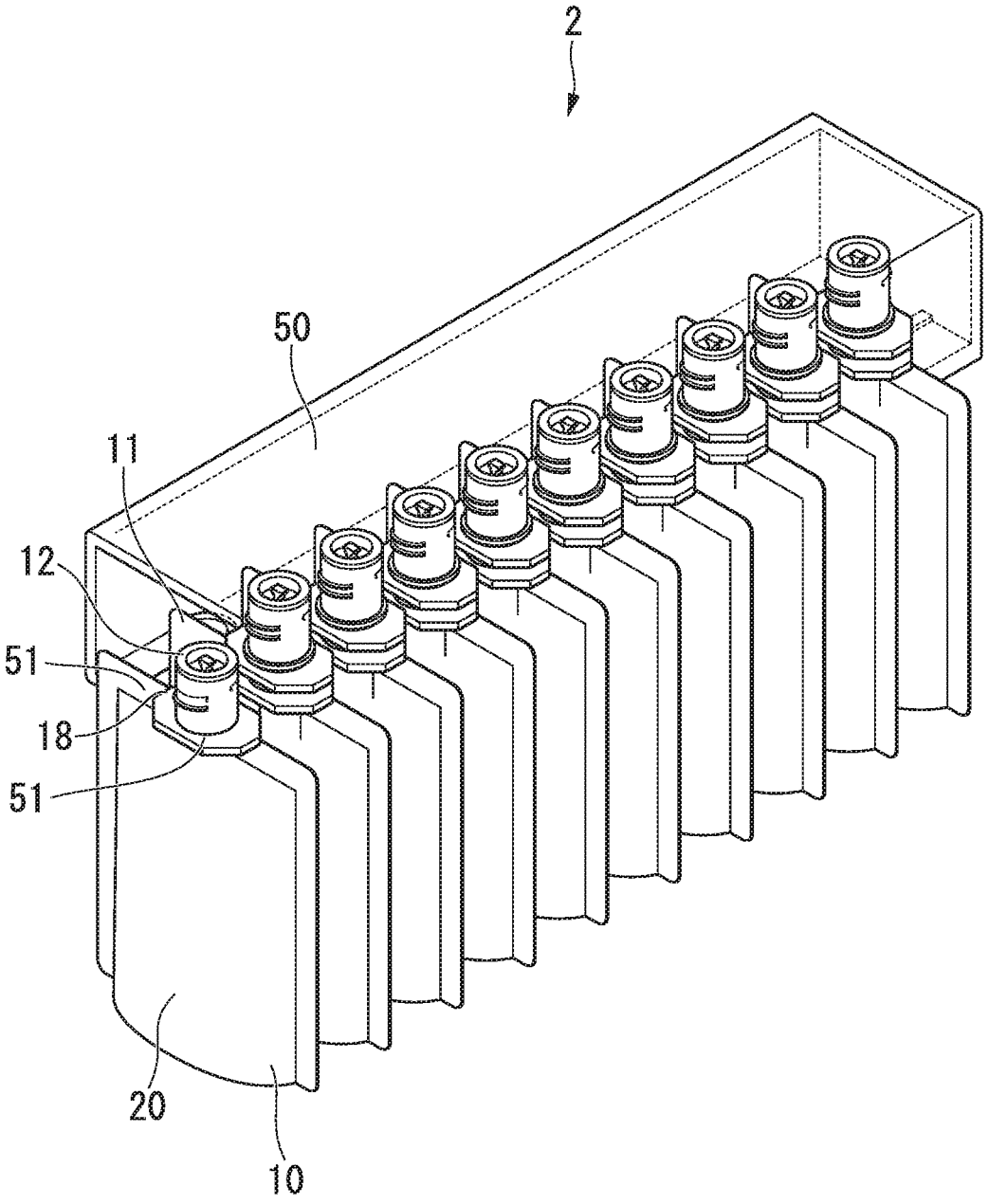
FIG. 7 is a perspective view of a pack of an embodiment.

FIG. 7 is a perspective view of a pack 2 of the present embodiment. In FIG. 7, the same regions as in FIGS. 1 to 3 are given the same symbols.

The pack 2 of the present embodiment is made up of ten spouted pouches 10 and one holder 50.

Each spouted pouch 10 is identical to that described in the aforementioned "method of manufacturing the spouted pouch aseptically filled with the contents." The spout 12 tightly stopped by the stopper 11 is attached to the spouted pouch 10, and an interior of the spouted pouch 10 is sterilized in a sealed state.

(Holder)

The holder 50 of the present embodiment has a curtain rail shape. A section from the flange 18 of the spout 12 to the stopper 11 tightly stopping the spout 12 is held in the holder 50. When the pack 2 is carried, if the holder 50 is raised, the flange 18 is caught on hanging portions 51, and the spouted pouch 10 is in a suspended state. In this state, a gap of 0.1 to 3 mm is preferably adapted to be present between a tip of a head of the stopper 11 and an inner wall of the holder 50. As such a gap is present, the surface of the stopper 11 is not easily damaged when the spouted pouch 10 is inserted into and removed from the holder 50. Also, even if the holder 50 is not used, the stopper 11 is sufficiently prevented from being removed from the spout 12. However, when the holder 50 is used, if the gap is within such a range, even if the stopper 11 rises in the spout 12 due to pressure or shock when the pack 2 is stored or conveyed, the head of the stopper 11 is repressed by the inner wall of the holder 50. Thus, it is possible to more reliably prevent the stopper 11 from being removed from the spout 12. Thus, it is possible to more reliably keep the interior of the spouted pouch 10 sterile.

Also, in the present embodiment, the ten spouted pouches 10 are accumulated together in an arranged state by the single holder 50. The pack 2 is stored or conveyed in this state.

Figure 8:
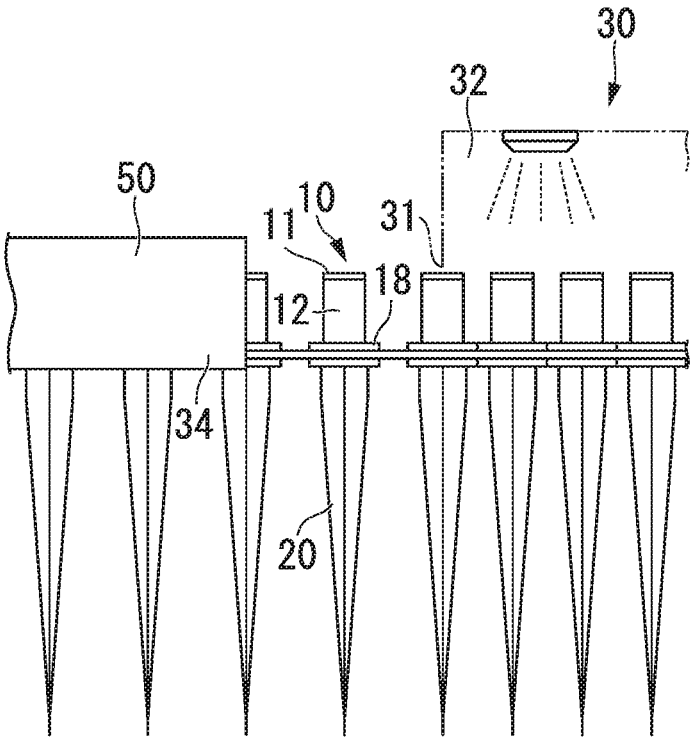
FIG. 8 is a schematic view illustrating an aspect in which spouted pouches are supplied into an aseptic chamber from the pack of the embodiment.

When the pack 2 is used in the aforementioned method of manufacturing the spouted pouch 10 aseptically filled with the contents, the spouted pouches 10 are continuously suspended on the conveyance plate 34 from the holder 50 in the supplying process, and are supplied into the aseptic chamber 30 (see FIG. 8).

A material of the holder 50 is not particularly limited, and may include, for instance, polystyrene or polyvinyl chloride.

The holder 50 may be manufactured by a known molding method. The molding method may include, for instance, profile extrusion molding.

A method of sterilizing the interior of the spouted pouch 10 is identical to that described in the aforementioned "method of manufacturing the spouted pouch aseptically filled with the contents." The sterilization may be performed any time before the spouted pouch 10 is used in the aforementioned "method of manufacturing the spouted pouch 10 aseptically filled with the contents" after the spout 12 tightly stopped by the stopper 11 is attached and sealed.

(Other Aspects)

The number of spouted pouches 10 in the pack is not limited to ten and is adequately set within a range of two or more.

The entire pack may be packaged by wrapping. The packaging is preferably sealed to more reliably maintain the sterilized condition of the interior of the spouted pouch 10. In this case, the sterilization of the interior of the spouted pouch 10 may be performed before or after the packaging.

(Operation and Effects)

According to the present embodiment, the plurality of spouted pouches are accumulated together in the arranged state by the holder, and thus the spouted pouches are easily stored and conveyed.

Also, according to the present embodiment, since it is easy to continuously suspend the spouted pouches on the conveyance plate in the supplying process of the present method, the aseptic chamber supply regions are simply and easily supplied into the aseptic chamber, and manufacturing efficiency of the present method is improved.

Further, according to the present embodiment, since the section from the flange of the spout to the stopper tightly stopping the spout is confined in the holder, it is more difficult for the stopper to be removed from the spout.

INDUSTRIAL APPLICABILITY

According to the present invention, the method of manufacturing the spouted pouch aseptically filled with the contents, in which the spouted pouch can be easily filled with the contents such as foods, the system can be small even if the cap has the tamperproof function and the complicated structure, and maintenance of the system is easy, can be provided.

REFERENCE SIGNS LIST

1: system
2: pack
10: spouted pouch
11: stopper
12: spout
13: opening
14: edge
15: mouth
16: protrusion
17: thread
18: flange
19: pouch attachment part
20: pouch
21: bottom
22: lower surface
23: outer surface
24: tip
25: base
30: aseptic chamber
31: supply section
32: sterilizing chamber
33: filling chamber
34: conveyance plate
35: sprayer
36: UV irradiator
37: drier
38: stopper attaching/detaching machine
39: drier
40: shutter
41: cap seamer
42: cap
43, 44: undercut
50: holder
51: hanging portion

The invention claimed is:

1. A method of manufacturing a spouted pouch aseptically filled with contents, the method comprising:

a supplying process of at least supplying a part of a spout and a stopper of the spouted pouch, to which the spout tightly stopped by the stopper is attached, into an aseptic chamber, an interior of the spouted pouch having been sterilized in a sealed state, and the spouted pouch being configured to be mounted with a cap having a tamperproof function such that the cap covers the spout and the stopper stopping an opening of the spout;

a sterilizing process of at least sterilizing a surface of the part of the spout and a surface of the stopper after the supplying process;

a stopper opening process of removing the stopper in an opening direction of the opening of the spout without rotating the stopper around a center of the opening from the spout after the sterilizing process;

a filling process of filling the spouted pouch with the contents through the spout after the stopper opening process;

a tightly re-stopping process of attaching any stopper removed in the stopper opening process to the spout in the opening direction without rotating the stopper around the center of the opening after the filling process;

a capping process of mounting the cap on the spout to cover the stopper after the tightly re-stopping process, and a stopper-carrying process of carrying, in the aseptic chamber, the stopper removed in the stopper opening process to the spouted pouch filled with the contents in the filling process, wherein the stopper is fitted into an interior of the cap and is integrated with the cap in the capping process such that the stopper can be removed in a state in which the stopper is fitted into the interior of the cap without remaining in the spout, wherein the sterilizing process, the stopper opening process, the filling process, and the tightly re-stopping process are performed in the aseptic chamber, wherein the capping process is performed outside the aseptic chamber, wherein a plurality of spouted pouches are held together by a holder and are in a suspended state, wherein the plurality of spouted pouches are continuously suspended on a conveyance plate from the holder in the supply process and are supplied into the aseptic chamber, wherein a first position at which the spouted pouch is disposed at the time the stopper is removed from the spout during the stopper opening process is upstream, in a conveyance line for the spouted pouch, of a second position at which the spouted pouch is disposed at the time the spouted pouch is filled with the contents through the spout during the filling process, wherein the second position is upstream, in the conveyance line, of a third position at which the spouted pouch is disposed at the time the stopper is attached to the spout during the tightly re-stopping process, wherein the spout of the spouted pouch at the third position is positioned downstream, in the conveyance line, of a filling portion used for filling the contents into the spouted pouch in the filling process, and wherein in the stopper-carrying process, the stopper is carried from the spouted pouch at the first position to the spouted pouch at the third position.

2. The method according to claim 1, wherein a central portion of the stopper includes a protrusion formed in an outward direction in a state in which the spout is tightly stopped by the stopper at the supplying process.

3. The method according to claim 1, wherein the aseptic chamber is constituted of two chambers: a sterilizing chamber and a filling chamber.

4. The method according to claim 3, wherein the sterilizing process is performed in the sterilizing chamber; and the stopper opening process, the filling process, and the tightly re-stopping process are performed in the filling chamber.

5. The method according to claim 3, wherein a fixed partition is installed between the sterilizing chamber and the filling chamber.

6. The method according to claim 5, wherein the fixed partition is a shutter capable of being opened and closed.

7. The method according to claim 1, wherein the cap is fitted around the spout in a screw type.

8. The method according to claim 1, wherein the stopper is integrated with the cap by an undercut.

9. The method according to claim 8, wherein the undercut is provided on an inner surface of the cap.

10. The method according to claim 9, wherein the undercut is provided on a protrusion of the inner surface of the cap.

11. The method according to claim 1, wherein an edge of the stopper extends outward, and a lower surface of a portion of the edge of the stopper is in close contact with a mouth of the spout, and an outer surface of the stopper is in close contact with an upper portion of an inner wall of the spout.

12. The method according to claim 1, wherein in the stopper opening process, the stopper is removed from the spout in the opening direction without being rotated around the center of the opening of the spout by using a protrusion provided on an upper surface of the stopper being picked up.

13. The method according to claim 1, wherein in the tightly re-stopping process, any stopper removed in the stopper opening process is compressed and fitted into the spout.

* * * * *